US011060269B2

(12) United States Patent
Zhang

(10) Patent No.: US 11,060,269 B2
(45) Date of Patent: Jul. 13, 2021

(54) BRACKET FOR INSTALLING SINK

(71) Applicant: Mingsen Zhang, Fujian (CN)

(72) Inventor: Mingsen Zhang, Fujian (CN)

( * ) Notice: Subject to any disclaimer, the term of this patent is extended or adjusted under 35 U.S.C. 154(b) by 9 days.

(21) Appl. No.: 16/525,597

(22) Filed: Jul. 30, 2019

(65) Prior Publication Data

US 2020/0109543 A1 Apr. 9, 2020

(30) Foreign Application Priority Data

Oct. 9, 2018 (CN) ..... 201821632646.1

(51) Int. Cl.
*E03C 1/324* (2006.01)
*A47K 1/05* (2006.01)

(52) U.S. Cl.
CPC ..... *E03C 1/324* (2013.01); *A47K 1/05* (2013.01); *E03C 2201/90* (2013.01)

(58) Field of Classification Search
CPC ..... E03C 1/324
USPC ..... 4/645, 643
See application file for complete search history.

(56) References Cited

U.S. PATENT DOCUMENTS 1,584,896 A * 5/1926 Sivon ..... A47C 9/022 248/240
1,956,986 A * 5/1934 Hetherington ..... A47B 81/02 248/229.14
1,961,922 A * 6/1934 Brandstetter ..... A47G 29/06 248/200.1
3,456,264 A * 7/1969 Flagg ..... E03C 1/328 4/645
4,413,868 A * 11/1983 Gorkiewicz ..... A47B 96/16 248/282.1
5,014,371 A * 5/1991 Heel ..... A45D 19/04 4/516
5,022,632 A * 6/1991 Beideck ..... B25B 27/02 254/132
5,230,109 A * 7/1993 Zaccai ..... E03C 1/324 4/643
5,518,340 A * 5/1996 Hall ..... F16L 1/00 138/97
5,622,354 A * 4/1997 Chagnot ..... E04G 21/26 254/100
5,853,163 A * 12/1998 Chagnot ..... E04G 21/26 254/100
6,142,710 A * 11/2000 Holland, Jr. ..... E02D 33/00 405/229
6,616,109 B1 * 9/2003 Jarrett ..... B65F 1/141 248/201

(Continued)

*Primary Examiner* — Lori L Baker

(57) ABSTRACT

A bracket for installing a sink, including a fixed base and a support rod, wherein the fixed base is provided with an installing structure for installing the fixed base onto a wall or a table wall, a lower end of the support rod extends into the fixed base in an upward-downward movable manner, the fixed base and the support rod are provided with an adjustment connection structure for enabling an upward-downward adjustment of the support rod and a rotatable installation of the support rod in the fixed base, an upper end portion of the support rod is provided with a jacking structure for abutting against a corner between a sink body of the sink and an installing plate for the sink, and the fixed base is installed with a holding structure for holding the lower end of the support rod.

5 Claims, 4 Drawing Sheets

(56) References Cited

U.S. PATENT DOCUMENTS

| | | | | |
|---|---|---|---|---|
| 6,820,290 | B1 * | 11/2004 | Mullick | A47K 3/30<br>4/643 |
| 7,571,497 | B2 * | 8/2009 | Hetzler | E03C 1/326<br>248/124.1 |
| 2005/0205730 | A1 * | 9/2005 | Carnevali | F16M 11/16<br>248/163.1 |
| 2007/0252060 | A1 * | 11/2007 | McPherson | F16M 11/18<br>248/282.1 |
| 2008/0185353 | A1 * | 8/2008 | Immerman | A47G 25/28<br>211/16 |
| 2009/0134287 | A1 * | 5/2009 | Klosowski | A47B 77/02<br>248/172 |
| 2010/0059642 | A1 * | 3/2010 | McLeod | A47H 1/142<br>248/207 |
| 2010/0294899 | A1 * | 11/2010 | Page | F16M 11/2092<br>248/125.8 |
| 2012/0025555 | A1 * | 2/2012 | Rasmussen | B60P 3/08<br>296/24.33 |

* cited by examiner

BRACKET FOR INSTALLING SINK

BACKGROUND OF THE INVENTION

The present disclosure relates to the technical field of hardware accessories, and in particular to a bracket for installing a sink.

In a kitchen or bathroom, utensils such as a sink, a bathtub, a washbasin and the like are often used, and these utensils typically include a sink body and an installing plate extending upwardly and outwardly from an outer periphery at an upper end of the sink body. An opening for installing the sink body is provided on a table top of a washing table or a cupboard, and after the sink body is installed into the opening, the installing plate abuts against the table top for supporting and fixing. Since the sink has a large capacity and bears a heavy weight, whereas the sink is supported on the table top merely through the installing plate without being supported or fixed in a reasonable manner, the table top or the sink is prone to deformation and to water leakage and seepage in case of deformation, thus affecting normal use of the sink. Currently, some sinks are supported through a welded tripod so as to improve the bearing capacity of the table top and the sink. However, such a tripod has a fixed supporting angle and a fixed supporting length, and requires a distance between the sink and a wall to be customized during manufacture. In the process of installing, the supported part has to be first closely supported on the sink before the tripod is fixed onto the wall. Such an installing process is cumbersome, and the parts cannot be easily adjusted as required for practical installation environments after the installation. Such a support member has a limited range of use and has a poor universality, making it not applicable to sinks of different types and different installation environments.

In view of this, the inventor conducted in-depth research on the above problems, and accordingly the present application is developed.

BRIEF SUMMARY OF THE INVENTION

An object of the present disclosure is to provide a bracket for installing a sink to improve a bearing capacity of the sink, and to adjust an installing angle and a supporting length of a supporting member according to actual conditions in order to support different sinks.

In order to achieve the above object, the following technical solutions are adopted in the present disclosure.

A bracket for installing a sink includes a fixed base and a support rod, wherein the fixed base is provided with an installing structure for installing the fixed base onto a wall or a table wall, a lower end of the support rod extends into the fixed base in an upward-downward movable manner, the fixed base and the support rod are provided with an adjustment connection structure for enabling an upward-downward adjustment of the support rod and a rotatable installation of the support rod in the fixed base, an upper end portion of the support rod is provided with a jacking structure for abutting against a corner between a sink body of the sink and an installing plate for the sink, and the fixed base is installed with a holding structure for holding the lower end of the support rod.

The fixed base includes a first vertical plate and a third vertical plate disposed opposite to each other, and a second vertical plate between the first vertical plate and the third vertical plate, wherein the first vertical plate, the second vertical plate and the third vertical plate are fixedly connected to form a rectangular structure having a cavity into which the lower end of the support rod extends; a spacing for rotation of the support rod is disposed between the second vertical plate and the support rod, and a free end portion of the first vertical plate and a free end portion of the third vertical plate each have an extension plate extending outwardly in parallel with the second vertical plate; the first vertical plate and the third vertical plate are located between the two extension plates, the extension plate is provided with installing holes extending through a thickness direction of the extension plate, screws pass through the installing holes, and the installing holes and the screws form the installing structure.

The first vertical plate and the third vertical plate are respectively provided with a waist-shaped hole extending in an up-and-down direction of the fixed base, and the two waist-shaped holes are symmetrically arranged; the fixed base is provided with a connecting bolt penetrating the lower end of the support rod, and the support rod is provided with through holes which tightly mate with the connecting bolt; a head of the connecting bolt is fixed outside of the waist-shaped hole in the first vertical plate, a free end of a stem of the connecting bolt is fixed outside of the waist-shaped hole in the third vertical plate through a nut, and the connecting bolt, the nut, the through holes and the waist-shaped holes constitute the adjustment connection structure.

An installing block, which is located below the lower end portion of the support rod, is fixed in the cavity of the fixed base, and the installing block is provided with a threaded hole having an internal thread therein and penetrating in an up-and-down direction of the installing block; a jacking bolt is threadingly engaged inside the threaded hole, a free end of a stem of the jacking bolt is arranged to face upward and abut against the lower end of the support rod, and the jacking bolt and the threaded hole constitute the holding structure.

The support rod has a rectangular tubular structure, two side walls of the four side walls of the support rod that are opposite to the two waist-shaped holes are provided with the through holes respectively, lower end portions of the other two side walls are each provided with an arch-shaped notch recessed upwardly, a width of the arch-shaped notch is greater than a diameter of the stem of the jacking bolt, and the free end portion of the stem of the jacking bolt extends into the lower end portion of the support rod so as to be located under the connecting bolt and abut against the connecting bolt.

An end surface at an upper end of the support rod is an inclined surface which is inclined upwardly, a higher side of the end surface at the upper end of the support rod is on the same side as the second vertical plate, and a lower side of the end surface at the upper end of the support rod is on the same side as the extension plates; the jacking structure is a jacking plate which has an upper abutting portion that is in fixed abutment with the end surface at the upper end of the support rod, and a lower abutting portion that is in fixed abutment with a side face of the upper end portion of the support rod that faces the second vertical plate, the upper abutting portion and the lower abutting portion are in arc transition, the upper abutting portion and the lower abutting portion each have a strip-shaped plate-like structure extending in a width direction of the support rod, and a length of the upper abutting portion and a length of the lower abutting portion are both greater than the width of the support rod.

According to the above technical solutions, the following advantageous effects can be obtained by the present disclosure: the support rod can move up and down and rotate in the fixed base under the cooperation of the connecting bolt and the waist holes, so as to facilitate adjusting the supporting length and the supporting angle according to different installation environments, and increase the versatility of the sink bracket; moreover, during the installation, it is only required to make the jacking structure lean against the corner between the sink body and the installing plate for the sink; with the screwing of the jacking bolt, the jacking structure at the upper end of the support rod closely abuts against the sink so that there is no need to implement one-step installation during the installation process. After the bracket is installed, the supporting length is adjusted by the jacking bolt. Such an installation is simple, which facilitates a quick installation of the bracket and a reasonable force bearing of the bracket. After the installation is completed, the jacking structure supports the corner between the sink body and the installing plate for the sink, and the gravity of the sink is transmitted from the support rod to the fixed base, thereby reducing the force on the table top and the installing plate for the sink, so that the force bearing of the sink is simple and reasonable, the bearing capacity of the sink is improved, and deformation of the sink is avoided.

LIST OF REFERENCE NUMERALS

1—fixed base; 101—first vertical plate; 102—second vertical plate; 103—third vertical plate; 104—extension plate; 2—support rod; 3—installing hole; 4—screw; 5—waist hole; 6—connecting bolt; 7—through hole; 8—nut; 9—jacking plate; 901—upper abutting portion; 902—lower abutting portion; 10—installing block; 11—jacking bolt; 12—arch-shaped notch.

DETAILED DESCRIPTION OF THE INVENTION

The present disclosure will be further described below in connection with the accompanying drawings and specific embodiments.

Figure 1:
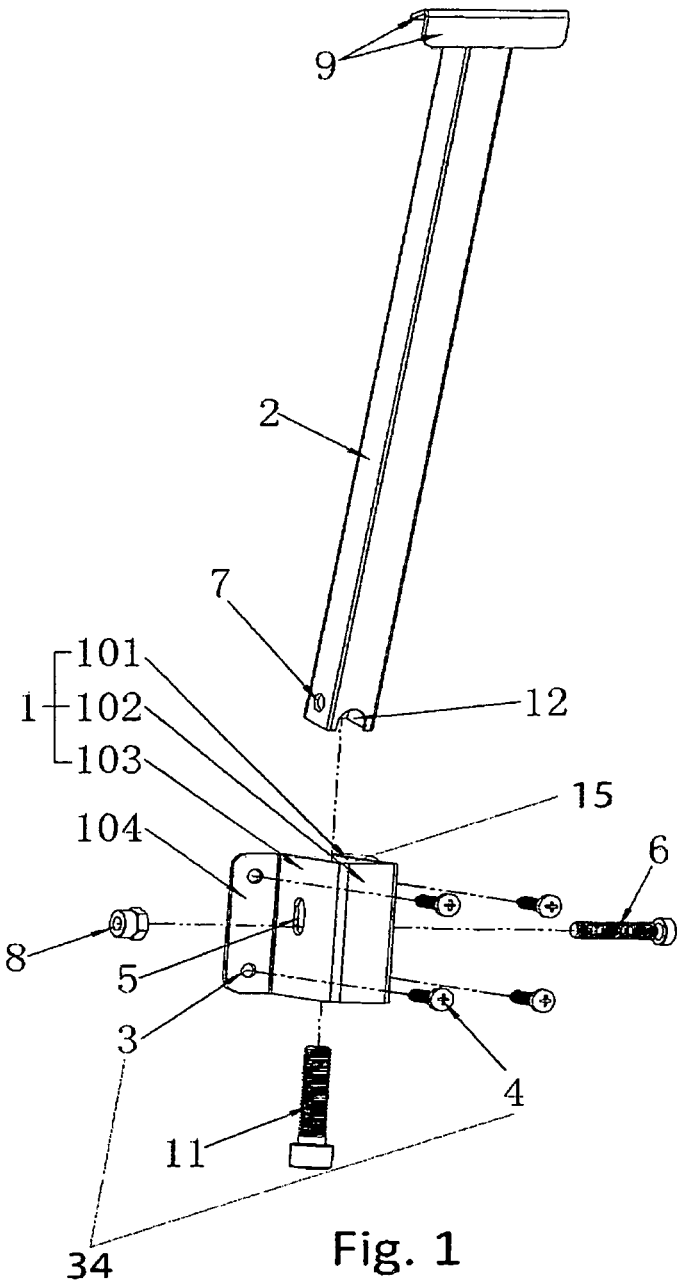
FIG. 1 is a schematic exploded view showing the structure of the present disclosure.

As shown in FIG. 1, a bracket for installing a sink 13 of the present disclosure includes a fixed base 1 and a support rod 2, wherein the fixed base 1 includes a first vertical plate 101 and a third vertical plate 103 that have the same length and are disposed opposite to each other, and a second vertical plate 102 between the first vertical plate 101 and the third vertical plate 103; the first vertical plate 101, the second vertical plate 102 and the third vertical plate 103 are fixedly connected to form a rectangular structure, that is, the first vertical plate 101 and the third vertical plate 103 are in parallel with each other, and are provided at two side edges of the second vertical plate 102 in a way of being perpendicular to the second vertical plate 102 respectively. The rectangular structure has a cavity 16 into which a lower end of the support rod 2 extends, that is, the fixed base 1 is a hollow rectangular structure that is open at three sides, and the fixed base 1 is provided with an installing structure 34 configured to install the fixed base 1 onto a wall or a table wall. Specifically, a free end portion of the first vertical plate 101 and a free end portion of the third vertical plate 103 each have an extension plate 104 extending outwardly in parallel with the second vertical plate 102. The extension plates 104 each have the same length as the first vertical plate 101, and the first vertical plate 101 and the third vertical plate 103 are located between the two extension plates 104, that is, the extension plates 104 are located outside of the cavity of the rectangular structure. In this way, a "几-shaped" structure is formed by the extension plates 104 and the fixed base 1. The extension plate 104 is provided with installing holes 3 extending through a thickness direction of the extension plate 104. Preferably, two installing holes 3 are provided in each of the extension plates 104, i.e., an upper installing hole 3 and a lower installing hole 4 that are spaced apart. A screw 4 passes through each of the installing holes 3, and the fixed base 1 is fixedly installed by passing the screws 4 through the installing holes 3 and threadingly engaging the screws 4 into a wall or a table wall. As such, the installing holes 3 and the screws 4 constitute the installing structure.

Figure 2:
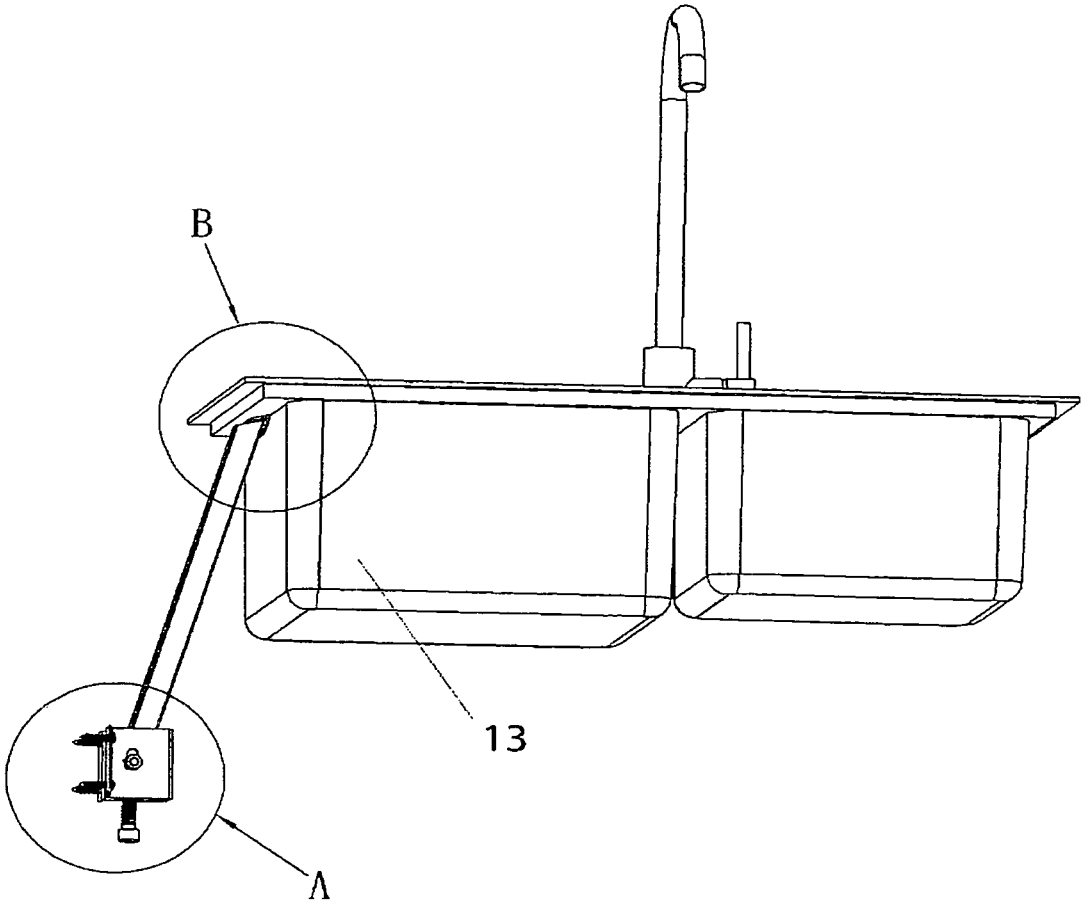
FIG. 2 is a schematic view of the present disclosure during use.
Figure 3:
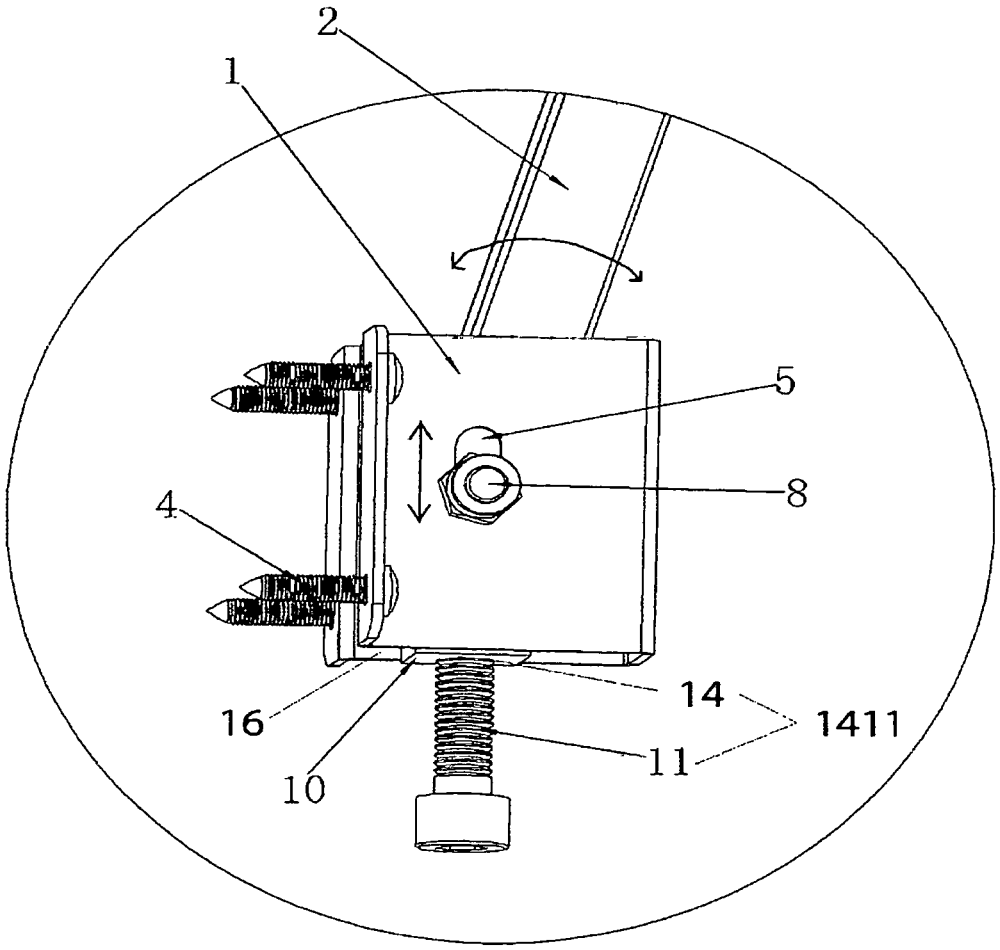
FIG. 3 is an enlarged view of a portion A in FIG. 2.

As shown in FIG. 2 and FIG. 3, a lower end of the support rod 2 extends into the fixed base 1 in an upward-downward movable manner, a spacing 15 for rotation of the support rod 2 is disposed between the second vertical plate 102 and the support rod 2, and the fixed base 1 and the support rod 2 are provided with an adjustment connection structure for enabling an upward-downward adjustment of the support rod 2 and a rotatable installation of the support rod 2 in the fixed base 1. That is, the lower end of the support rod 2 is installed in the cavity of the fixed base 1 via the adjustment connection structure, and at the same time, the adjustment connection structure enables the support rod 2 to move up and down and rotate in the fixed base 1. Preferably, the adjustment connection structure is configured in the following manner: the first vertical plate 101 and the third vertical plate 103 are respectively provided with a waist-shaped hole 5 extending in an up-and-down direction of the fixed base 1, that is, a length direction of the waist-shaped hole 5 is the up-and-down direction of the fixed base 1, and the two waist-shaped holes 5 are symmetrically arranged; a connecting bolt 6 penetrating the lower end of the support rod 2 is provided in the fixed base 1, and through holes 7 for tightly mating with the connecting bolt 6 are disposed in the support rod 2 so that the support rod 2 and the connecting bolt 6 are connected together to form one piece which moves in synchronization. A head of the connecting bolt 6 is fixed outside of the waist-shaped hole 5 in the first vertical plate 101, a free end of a stem of the connecting bolt 6 is fixed outside of the waist-shaped hole 5 in the third vertical plate 103 through a nut 8. That is, the stem of the connecting bolt 6 passes through the waist-shaped hole 5 in the first vertical plate 101, the through holes 7 at the lower end of the support rod 2 and the waist-shaped hole 5 in the third vertical plate 103 in sequence, and a tip end of the stem of the connecting bolt 6 is fixed by the mating nut 8 after extending out of the waist-shaped hole 5 in the third vertical plate 103 so that the support rod 2 is installed in the fixed base 1. Moreover, by loosening the nut 8, the connecting bolt 6 can rotate at the same time of moving up and down in the waist-shaped holes 5, so that the support rod 2 is also capable of rotating about the connecting bolt 6 at the same time of moving up and down. In this way, the connecting bolt 6, the nut 8, the through holes 7 and the waist-shaped holes 5 constitute the adjustment connection structure.

Figure 4:
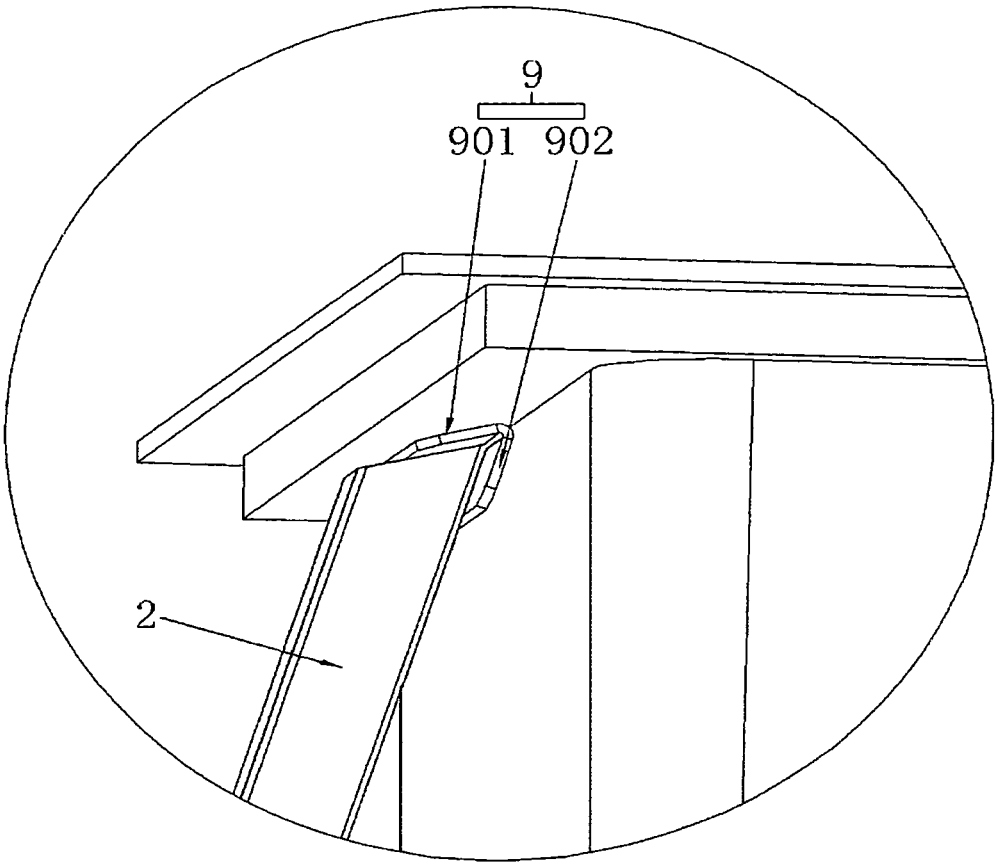
FIG. 4 is an enlarged view of a portion B in FIG. 2.

As shown in FIG. 1, FIG. 2 and FIG. 4, an upper end portion of the support rod 2 is provided with a jacking structure for abutting against a corner between a sink body of the sink and an installing plate for the sink. Specifically, an end surface at an upper end of the support rod 2 is an inclined surface which is inclined upwardly, a higher side of the end surface at the upper end of the support rod 2 is on the same side as the second vertical plate 102, and a lower side of the end surface at the upper end of the support rod 102 is on the same side as the extension plates. That is, the upper end portion of the support rod 102 extends inclinedly upward in a direction from the extension plates 104 towards the second vertical plate 102 so that the end surface at the upper end of the support rod 2 has a pointed portion at a side facing the second vertical plate 102. In this way, when the support rod 2 supports in an inclined manner, the pointed portion thereof abuts against the corner between the sink body and the installing plate for the sink. The jacking structure is a jacking plate 9 which has an upper abutting portion 901 that is in fixed abutment with the end surface at the upper end of the support rod 2, and a lower abutting portion 902 that is in fixed abutment with a side face of the upper end portion of the support rod 2 that faces the second vertical plate 102. That is, the jacking plate 9 is a corner structure that abuts against the pointed portion. The upper abutting portion 901 and the lower abutting portion 902 are in arc transition. The arc transition is located at the pointed portion of the support rod 2, and the upper abutting portion 901 and the lower abutting portion 902 each have a strip-shaped plate-like structure extending in a width direction of the support rod 2. A length of the upper abutting portion 901 and a length of the lower abutting portion 902 are both greater than the width of the support rod 2. That is, the jacking plate 9 is perpendicular to the support rod 2, and the length of the jacking plate 9 is greater than the width of the support rod 2 so as to increase the range of force bearing and stability at the jacking portion.

As shown in FIG. 1 and FIG. 3, the fixed base 1 is installed with a holding structure 1411 for holding the lower end of the support rod 2, that is, after the support rod 2 extends into the fixed base 1 and adjusted through upward and downward movement, the holding structure fixes the lower end of the support rod 2 by pressing upwardly. The holding structure is preferably configured in the following manner: an installing block 10, which is located under the lower end portion of the support rod, is fixed in the cavity of the fixed base 1, that is, the installing block 10 is located between the lower end of the first vertical plate 101 and the lower end of the third vertical plate 103; the installing block 10 is provided with a threaded hole (14) having an internal thread therein and penetrating in an up-and-down direction of the installing block 10; a jacking bolt 11 is threaded inside the threaded hole, a free end of a stem of the jacking bolt 11 is arranged to face upward and abut against the lower end of the support rod 2 when the jacking bolt 11 is screwed upward. The jacking bolt 11 and the threaded hole constitute the holding structure.

Further, as shown in FIG. 1, the support rod 2 has a rectangular tubular structure, two side walls of the four side walls of the support rod 2 that are opposite to the two waist-shaped holes 5 are provided with the through holes 7 respectively, lower end portions of the other two side walls are each provided with an arch-shaped notch 12 recessed upwardly, a width of the arch-shaped notch 12 is greater than a diameter of the stem of the jacking bolt 11, and the free end portion of the stem of the jacking bolt 11 extends into the lower end portion of the support rod 2 so as to be located under the connecting bolt 6 and abuts against the connecting bolt 6. With the arrangement of the arch-shaped notch 12, the support rod 2 still can rotate after the jacking bolt 11 extends into the support rod 2, and the inclined angle of the support rod 2 is prevented from being affected by the extending of the jacking bolt 11.

When assembling the bracket for installing a sink of the present disclosure, the lower end of the support rod 2 extends into the hollow cavity of the fixed base 1, and the connecting bolt 6 passes through the waist-shaped hole 5 in the first vertical plate 101, the through holes 7 in the support rod 2 and the waist-shaped hole 5 in the third vertical plate 103 in sequence. Then, after the free end of the stem of the connecting bolt 6 extends out of the waist-shaped hole 5 in the third vertical plate 103, the nut 8 is screwed onto the free end of the stem of the connecting bolt 6 so as to install the support rod 2 onto the fixed base 1. At this point, the support rod 2 can move up and down and rotate in the fixed base 1 under the cooperation of the connecting bolt 6 and the waist holes 5. According to a distance from the sink to the wall, the jacking structure at the upper end portion of the support rod 2 is made contact with the corner between the sink body and the installing plate for the sink, and then the extension plates 104 on the fixed base 1 are made abut against the wall or the table wall. The screws 4 pass through the installing holes 3 and are threaded into the wall or the table wall. At this point, the fixed base 1 is fixed onto the wall or the table wall, and the support rod 2 is in an inclined state and is leaning against the corner between the sink body and the installing plate for the sink. Since the jacking bolt 11 is disposed in the fixed base 1 and is located under the support rod 2, and the free end of the stem of the jacking bolt 11 abuts against the lower end of the support rod 2, the support rod 2 is continuously jacked up with the continuous upward screwing of the jacking bolt 11 so that the jacking structure at the upper end portion of the support rod 2 abuts against the corner between the sink body and the installing plate for the sink. When the jacking structure is in close abutment and contact with the sink, the nut 8 on the connecting bolt 6 is then locked and fixed so that the support rod 2 is fixedly connected to the fixed base 1. Under the action of the jacking bolt 1 and the connecting bolt 6, the support rod 2 can fix the sink in a better way so that the gravity of the sink is transmitted to the fixed base 1 through the support rod 2, thereby reducing the force on the table top and the installing plate for the sink, and improving the bearing capacity of the sink. Since the jacking structure supports the corner between the sink body and the installing plate for the sink, the force bearing of the sink is more reasonable and sink deformation is avoided. Moreover, since the support rod 2 can move up and down and rotate, adjustment of the supporting length and the supporting angle according to different installation environments is facilitated, and the versatility of the sink bracket is increased. In addition, with the screwing of the jacking bolt 11, the jacking structure at the upper end of the support rod 2 closely abuts against the sink so that there is no need to implement one-step installation during the installation process. After the bracket is installed, the supporting length is adjusted by the jacking bolt 11, which facilitates a quick installation of the bracket and the reasonable force bearing of the bracket.

The present disclosure has been described above in detail with reference to the accompanying drawings. However, the embodiments of the present disclosure are not merely limited to the those described above, and various modifications may be made to the present disclosure by those skilled in the art based on the related technology. All the modifications will fall within the scope of protection of the present disclosure.

What is claimed is:

1. A bracket for installing a sink, comprising a fixed base and a support rod, wherein the fixed base is installed via an installing structure, a lower end of the support rod extends into the fixed base; the support rod is movable upward-downward in the fixed base and is rotatable with respect to the fixed base; an upper end of the support rod is configured with a jacking structure for abutting against a corner between a sink body of the sink and an installing plate for the sink, and the fixed base is installed with a holding structure for holding the lower end of the support rod; the fixed base comprises a first vertical plate and a third vertical plate opposite to each other, and a second vertical plate between the first vertical plate and the third vertical plate, wherein the first vertical plate, the second vertical plate and the third vertical plate are fixedly connected to form a rectangular structure having a cavity into which the lower end of the support rod extends; there is a spacing between the second vertical plate and the support rod for rotation of the support rod, and a free end portion of the first vertical plate and a free end portion of the third vertical plate each has an extension plate extending outwardly in parallel with the second vertical plate; the first vertical plate and the third vertical plate are positioned between the two extension plates, each extension plate has installing holes extending through a thickness direction thereof, screws are inserted into the installing holes respectively; the installing holes of the extension plates and the screws together define the installing structure.

2. The bracket for installing a sink according to claim 1, wherein each of the first vertical plate and the third vertical plate has a waist-shaped hole extending in an up-and-down direction of the fixed base, and the two waist-shaped holes are symmetrically arranged; a connecting bolt penetrates the fixed base via the waist-shaped holes and the lower end of the support rod via through holes at the lower end of the support rod; the connecting bolt is tightly fitted in the through holes after penetrating through the through holes; after the connecting bolt penetrates through the fixed base and the lower end of the support rod, a head of the connecting bolt is positioned outside the waist-shaped hole of the first vertical plate, a free end of a stem of the connecting bolt is positioned outside the waist-shaped hole of the third vertical plate and is fixed in position with respect to the waist-shaped hole of the third vertical plate through a nut.

3. The bracket for installing a sink according to claim 2, wherein an installing block is fixedly connected to the fixed base in the cavity of the fixed base below the lower end of the support rod; the installing block has a threaded hole having an internal thread therein and penetrating in an up-and-down direction of the installing block; a jacking bolt is threaded inside the threaded hole, a free end of a stem of the jacking bolt is arranged to face upward, extends into the lower end of the support rod under the connecting bolt, and abuts against the connecting bolt, and the jacking bolt and the threaded hole together define the holding structure.

4. The bracket for installing a sink according to claim 3, wherein the support rod has a rectangular tubular structure having four side walls, the through holes of the support rod are positioned on two opposite side walls of the four side walls of the support rod corresponding to the two waist-shaped holes, lower end portions of other two opposite side walls of the four side walls of the support rod are each recessed upwardly to form an arch-shaped notch, a width of each arch-shaped notch is greater than a diameter of the stem of the jacking bolt.

5. The bracket for installing a sink according to claim 1, wherein an end surface at the upper end of the support rod is an inclined surface which is inclined upwardly along a direction from the extension plates towards the second vertical plate; the jacking structure is a jacking plate which has an upper abutting portion that is in fixed abutment with the end surface at the upper end of the support rod, and a lower abutting portion that is in fixed abutment with a side face of an upper end portion of the support rod facing towards the second vertical plate, a transition between the upper abutting portion and the lower abutting portion has an arc shape, the upper abutting portion and the lower abutting portion are each being an elongated plate extending in a width direction of the support rod, and a length of the upper abutting portion and a length of the lower abutting portion are both greater than a width of the support rod.

* * * * *